US005555640A

United States Patent [19]

Ou

[11] Patent Number: 5,555,640

[45] Date of Patent: Sep. 17, 1996

[54] HOUSEHOLD DRYING CENTER

[76] Inventor: Chan C. Ou, 12 F., 275 Yuan-Hua Rd., Chungli City, Taoyuan Hsien, Taiwan

[21] Appl. No.: 506,479

[22] Filed: Jul. 25, 1995

[51] Int. Cl.[6] ..... F26B 19/00; F26B 25/06

[52] U.S. Cl. ..... 34/202; 34/237; 34/204; 34/240; 211/181; 211/204; 312/229; 312/249.9

[58] Field of Search ..... 34/89, 90, 103, 34/603, 604, 607, 138, 170, 192, 194, 197, 204, 237, 240, 202, 218, 239; 211/88, 181, 204; 312/229, 249.9, 213

[56] References Cited

U.S. PATENT DOCUMENTS

| | | | |
|---|---|---|---|
| 2,091,746 | 8/1937 | Wiley | 34/90 |
| 2,561,652 | 7/1951 | Doolan | 34/89 |
| 2,572,893 | 10/1951 | Richter | 34/89 |
| 4,875,592 | 10/1989 | Waller | 211/88 |

*Primary Examiner*—John M. Sollecito
*Assistant Examiner*—Steve Gravini
*Attorney, Agent, or Firm*—Bacon & Thomas

[57] ABSTRACT

A multipurpose household drying center which can provide versatile drying functions for a wide variety of clothings, fabric articles and other household goods. A blower and a heating chamber are disposed on the top portion of a cabinet to generate forced and heated air downward into a drying chamber in the cabinet below the heating chamber. There are horizontally disposed heat diffusion plates under the heating chamber and vertically disposed air ducts on the side walls of the cabinet to enable heated air to be evenly distributed and filled in the drying chamber for uniform drying of the goods held therein. A support stand having a horizontal and rectangular frame secured on the top ends of a pair of spaced and vertical telescopically structured tubes is disposed within the drying chamber. The rectangular frame is spaced from the top, bottom and side walls of the drying chamber. The support stand can support a for hanging clothes, can allow large size or bulky goods be draped thereover, and can support a wire basket for holding delicate or odd shape goods for drying. There are side rods on the side walls for hanging articles. A base grid is provided above the bottom wall to hold heavy or odd shape goods for drying. The clothes and goods are dried without tumbling, thus avoiding fraying or wrinkles.

10 Claims, 11 Drawing Sheets

HOUSEHOLD DRYING CENTER

BACKGROUND OF THE INVENTION

1. Field of the Invention

The present invention relates to an for drying laundry, fabric articles and other household goods and more particularly to a multipurpose dryer which can serve as a household drying center to provide versatile drying functions for a wide variety of fabric and non-fabric goods of different type, material, size or weight.

2. Description of the Prior Art

A household usually has many different types of Fabric and non-fabric goods that need to be washed and/or dried from time to time. Those goods are of different materials and have different drying requirements. Besides the regular laundry such as underwear, casual wear and linen that can withstand the fraying of a conventional tumbler dryer, there are other delicate clothing, heavy articles or bulky goods that need special or different care in the drying process. For examples, after returning home from work or school on a rainy day, the damp coat, suit, dress or pants usually should be hung for drying, the dripping umbrella or raincoat should be handled separately, and the soaked shoes or boots need still different handling. In the warm season, the suit, dress, blouse or trousers have to be aerated and dried to expel the traces of perspiration or other odors. Nylon stocking, pantyhose and woolen sweater should be dried at a relatively low temperature to avoid excessive shrinking. Knitted wear usually should not be hung on a hanger or it may stretch and deform. Some bulky goods such as quilt, comforter, sleeping bag or blanket needs to be draped and spread for drying once in a while to prevent mold. There are still other odd shape or heavy goods that need to be washed or dried occasionaly, such as hat, cushion, stuffed toys, wadded jacket, sneakers, and the like. Then there are dishes and tableware that need to be washed and dried almost daily, and kitchen utensils that need to be washed and dried for stacking and storage.

Over the years, a prolific number of drying and heating appliances have been developed and marketed. Numerous drying means have been disclosed in the prior art trying to meet the aforesaid requirements. However they mostly can provide only a limited range of function to serve a narrow scope of purpose. A family could end up buying a number of different drying or heating appliances, some of which could not be or efficiently used. Adding up together, they could cost a lot of money and occupy much house space. It is not economically or practically sensible. More detailed elaboration of the prior art appliances and their problems will be given below as a background and comparison for the improvement of the present invention.

As is generally known, the widely used tumbler dryer equipped with a rotary drum has relatively high drying efficiency for general household laundry that can withstand shrinkage or wrinkling. Its limitations and shortcomings are also well known. Notably, the constant tossing, dropping, bumping and tangling of the goods caused by the rotary drum often result in fraying and wrinkles on the fabrics of the laundry. It is therefore not desirable for drying delicate or high value clothing or articles such as suit, coat, dress, hat, woolen sweater, pantyhose or the like. It is also not suitable for drying heavy or odd shape goods such as shoes, boots, stuffed toys, umbrella or the like. The relatively small size of the rotary drum of a domestic dryer also does not permit to be for drying bulky goods such as quilt, pillow or sleeping bag.

There are many different proposals being advanced in the prior art trying to resolve some of the aforementioned problems by providing static drying chamber or means which can hold the drying goods stationary during the drying process. However they rarely have achieved significant commercial success as they also have their share of drawbacks or functional limitations. The following are some of the notable examples.

U.S. Pat. Nos. 2,707,838 (Braman), 3,626,602 (Glowacki) and 3,858,331 (Lord) disclose clothes dryers or garment heating apparatus that generally have an upright central strut which supports hangers or horizontally extended bars to suspend the clothes for drying. Some of them do not have a defined drying enclosure (e.g. Braman and Glowacki) which could cause significant heat loss thus resulting in lower drying efficiency. Most important, the central strut and hanger become the boundry and limitation of the type of applicable goods. They are in general not suitable for drying bulky or odd shape goods such as quilt, cushion, stuffed toys, shoes or the like. There are other type of dryers which offer generally cantilever bars having one end thereof fixed on a wall. Representative disclosures include U.S. Pat. Nos. 3,256,617 (Konstandt), 3,975,833 (Rothauser et al.) and 4,924,604 (Colodner et al.). Like those proposals with a central strut cited above, some of those devices also have a defined drying enclosure which results in dubious drying efficiency (e.g. Konstandt, Rothauser et al. and Colodner et al.). Furthermore, with one end of the bars or one side of the device fixed on a wall, they have severe functional limitation and protability problem. They are also not desirable for drying bulky or odd shape goods such as comforter, pillow, stuffed toys, sneakers or the like.

There are still more references being disclosed in the prior art that provide generally a well defined drying enclosure and has hanger supporting bars or rods disposed between two opposite walls or fixed on a top wall of a static housing. Again, the hanger, the length of the bar or rod and the way the bar or rod is disposed become the limitation and restriction of their applicability. They usually have another type of problem. These devices generally have the drying medium (usually heated air) flowing into the drying enclosure from one side and discharging out at a remote or opposite side. Experiments show that the drying medium cannot be evenly distributed across the entire static drying enclosure this way. The goods or parts of the goods located around the inlet port of the heated air usually will be heated and dried while those goods or other parts of the goods remote from the inlet port will remain damp much longer. Representative disclosures include U.S. Pat. Nos. 2,728,996 (Mason), 3,152,876 (Laing), 3,280,477 (Rawlins), 3,449,838 (Chancellor,Jr.), 3,670,425(Benjamin et al.), 4,180,919 (Baltes),4,819,341 (Gayso) and 4,873,773(Canonge).

There are also discolsures in the prior art trying to provide a which can serve multiple function. U.S. Pat. Nos. 4,785,162 (Kuo) and 4,856,206 (Klein) are two of the examples. However they are mainly for drying small size articles. They are not suitable for drying regular laundry, clothes or bulky goods such as blanket or wadded jacket.

Since a general purpose dryer like any of those cited above cannot fully meet all the drying requirments of a household, some specific drying means have been proposed or developed to meet the specific drying function needed. For examples, U.S. Pat. No. 4,151,658 (Hibino et al.) revealed a bed clothes drying device. U.S. Pat. No. 4,578,881 (Karlsson) disclosed a drier for knitted garments. U.S. Pat. No. 4,684,787 (Bunting) disclosed a heating cabinet mainly for small size and thick fabric article. U.S. Pat. No.

4,959,911(Wolens et al.) revealed an apparatus for drying sweater and small size articles. U.S. Pat. Nos. 5,016,364(Cochrane) and 5,379,525(Raynor) disclosed dryers for shoes or boots.

Besides the dryers for drying laundry and fabric articles, there are other type of drying appliances in a general household. e.g. dish dryer for drying dishes and tableware. It usually cannot even be used for drying kitchen utensils such as pot, pan or boiler due to its small drying cabinet. U.S. Pat. No. 4,812,621 (Brotherton) is but one of the examples.

From what have been described heretofore, it can be seen that there are many different types of drying requirements in a general household. To the Applicant's knowledge, there is no dryer, either produced and marketed or disclosed in the prior art, which can fully or efficiently satisfy those requirements.

SUMMARY OF THE INVENTION

It is therefore, in view of the aforesaid requirements and problems, an object of the present invention to provide a multipurpose drying apparatus which can serve as a drying center to offer versatile drying functions for a wide variety of fabric and non-fabric goods of different type, material, size, shape or weight.

It is another object of the present invention to provide a multipurpose drying apparatus which has support means to allow the drying goods be disposed or suspended stationary during the drying process so that there is no fraying or additional wrinkling incurred by the drying goods.

It is a further object of the present invention to provide a multipurpose dryer which can offer different levels of heating output and thus can result in different drying temperatures so that different types of goods can be dried at the most desirable temperature range without undue shrinking or damage.

It is an additional object of the present invention to provide a dryer which includes means for evenly distributing the drying medium, usually heated air, across the entire drying enclosure so that the goods in the enclosure can be dried efficiently and uniformly.

It is yet another object of the present invention to provide a multipurpose dryer which can efficiently dry ordinary laundry, delicate articles as well as bulky goods.

It is still another object of the present invention to provide a multipurpose dryer which can be used for drying dishes, tableware and kitchen utensil.

It is yet a further object of the present invention to provide a multipurpose dryer which can offer multiple functions for drying a wide range of goods so that the dryer can be more frequently used, and increase its utilization and economic value.

In order to accomplish the aforementioned and other objects, the present invention contemplates to use a cabinet which has a heating chamber at the upper portion and a drying chamber below the heating chamber and with a perforated heat diffusion plate set between them. There is a blower located on the top of the cabinet and above the heating chamber for producing forced air to enter into the heating chamber and be heated. The heated air then passes through the heat diffusion plate and flows into the drying chamber.

The cabinet has about the size of footprint on the floor space as a conventional laundry dryer so that it can be conveniently fitted in a house, whether it is a single unit or multi-unit residence. An access door is provided on a side wall of the drying chamber for loading or discharging of the drying goods. In one embodiment, the heating chamber has a plural number of heating elements, preferably radiative heating tubes with heat dissipating fins on the outside surface and with resistance wire as cores disposed therein. By wiring the heating elements in parallel or series or a combination of parallel and series, varying heating power output can be generated, thus resulting in different temperature levels of heated air for drying different types of goods.

In order to provide uniform distribution of heated air across the entire drying chamber, in one embodiment of the present invention, a hollow heated air duct is provided vertically on each side wall of the cabinet except the door. The air duct has an open top end communicating with the heating chamber through the heat diffusion plate and a closed bottom end. The air duct, on the lateral wall facing toward the drying chamber, has a plural number of spaced apertures formed therein. Thus heated air from the heating chamber can enter into the drying chamber from the heat diffusion plate at the top and from the air ducts on the side walls of the cabinet. The number and size of the apertures and the distance between them are selectively formed so that heated air can enter into the drying chamber, across the entire space from top to bottom, in an evenly distributed way to achieve uniform drying of the goods held in the drying chamber.

There is a control panel disposed on the top of the top wall and above the door. A timer, temperature selection switch and a power-on signal light are provided thereon for user to control the operation of the dryer. A thermostat is also provided to prevent the drying chamber from overheating.

There is a support means disposed in the interior of the drying chamber for suspending or holding of the drying goods. The support means includes a support stand and a base grid horizontally located above the base bars of the support stand. In one embodiment, a support stand includes a substantially horizontal and rectangular frame formed by a pair of spaced bars in transverse direction and a pair of spaced bars in longitudinal direction. The rectangular frame is secured on the top ends of a pair of spaced and upright tubes. The lower ends of the upright tubes are fixed on a pair of spaced base bars each being supported by a pair of brackets secured on the two opposite side walls of the cabinet. The upright tubes are preferably telescopically structured so that the top end, consequently the rectangular frame disposed thereon, can be adjusted upward or downward. One or both of the transverse bars may be telescopically structured at two ends. When retracted, the transverse bars and the rectangular frame are spaced from the top, bottom and side walls of the drying chamber. The support means structured like this can provide multipurpose support function for the drying goods. The transverse bars can support a to suspend clothes for drying without the fraying or wrinkles that would otherwise occur in a conventional tumbler dryer. Thus they can be used for drying ordinary laundry as well as delicate and high value clothes such as coat, suit, dress, shirt and trousers. When the transverse bars are retracted, large size or bulky goods can be draped over the rectangular frame. The edges of the goods are suspended and pendent in the spaces formed between the stand and the side walls. Thus both outside and inside surfaces of the goods can communicate with the heated air during the drying process. Therefore it can be used to dry large size or bulky goods such as bed sheet, quilt, blanket or sleeping bag effectively. The rectangular frame further can support a wire basket for holding drying goods that are not suitable for hanging or draping, such as hat, shoes, cushion, stuffed toys, woolen sweater and knitted wear. Dishes and tableware can also be placed in a wire basket for drying.

The grid on the base bar can also be used to support other heavy or odd shape goods for drying, including boots, sneakers, large size cushion or stuffed toys, kitchen utensils and the like.

The present invention further contemplates to dispose horizontal side rod with two pivotal arms on each side wall for hanging or draping small size articles such as underwear, sock, towel, handkerchief, stocking, pantyhose and the like. Dripping umbrella can also be hung on a side rod for drying.

Above the bottom wall of the cabinet and below the base bars of the stand, there is provided a drain board which has a sloped surface tilted toward a drain outlet in the center. A removable drip tray is provided under the drain outlet to collect the drip from the wet laundry or umbrella There is an air outlet port formed in the drain board adjacent the drain outlet for discharging the moisture laden air out from the drying chamber. An air discharging duct with the front end engaging with the air outlet port and the rear end locating on the rear wall of the cabinet is disposed under the drain board. The rear end of the air discharging duct may engage with a hose, preferably a flexible hose used in a conventional washing machine, so that when the dryer of the present invention is located in the house, the moisture-laden air from the drying chamber can be discharged outdoors via a hose or a plural number of connecting hoses.

These and other objects, advantages and features of the present invention will be apparent from the following description of the preferred embodiments considered along with the accompanying drawings. The accompanying drawings are only to serve for reference and illustrative purpose, and do not intend to limit the scope of the present invention.

DETAILED DESCRIPTION OF THE PREFERRED EMBODIMENT

Figure 1:
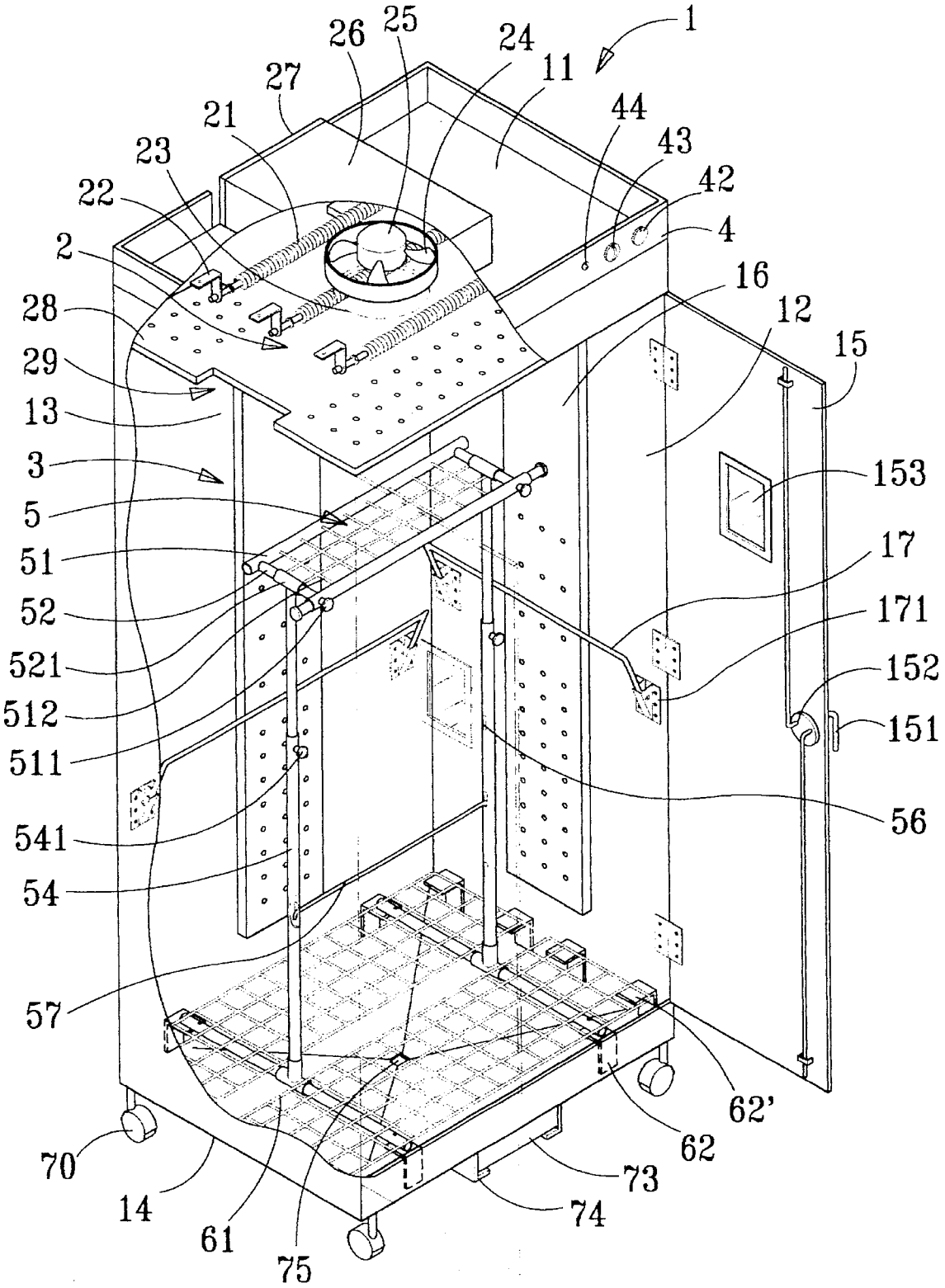
FIG. 1 is a perspective view, partly cutaway, of an embodiment of a household drying center of the present invention.
Figure 2:
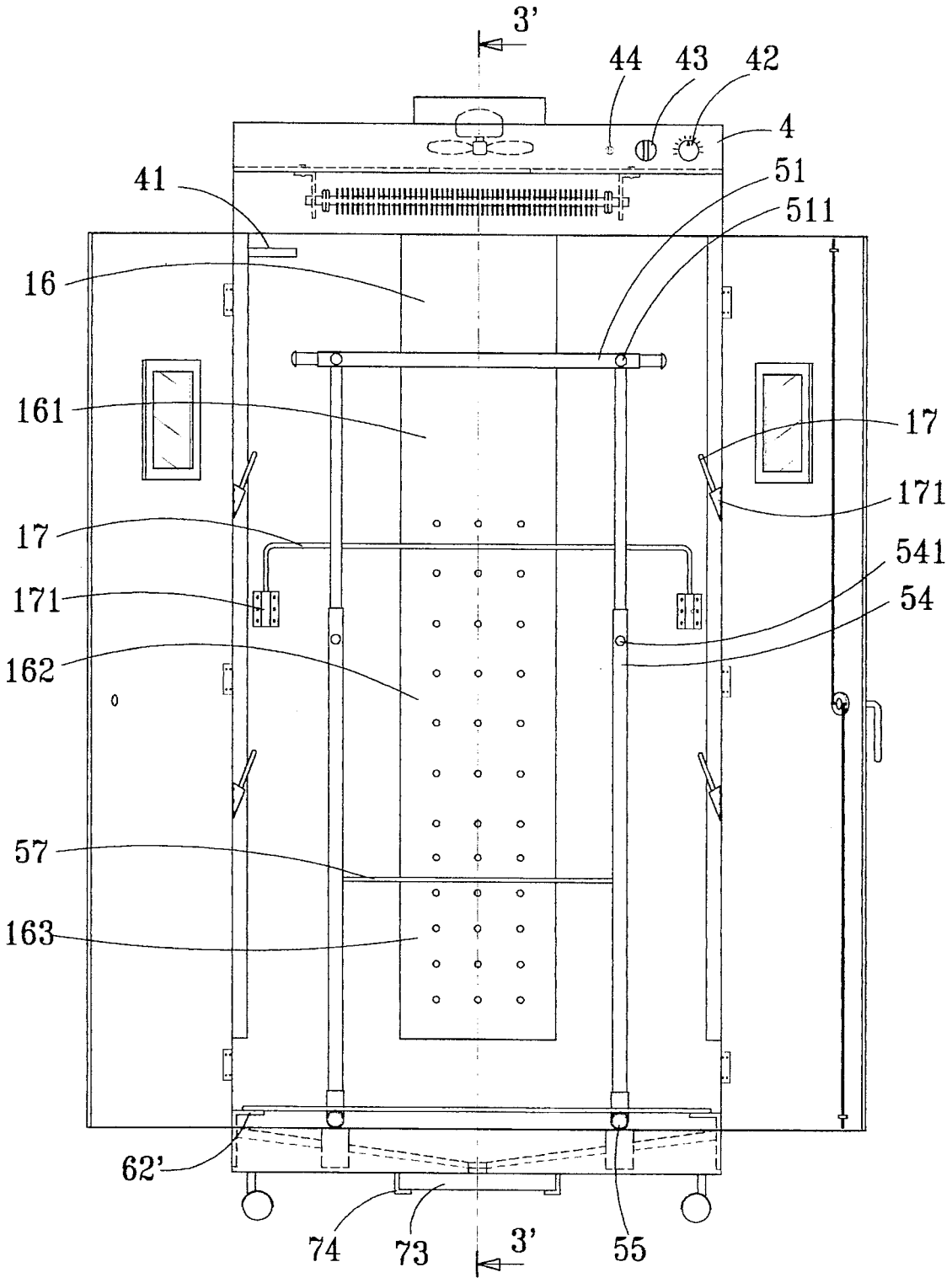
FIG. 2 is a front elevation view of the present invention shown in FIG. 1.
Figure 3:
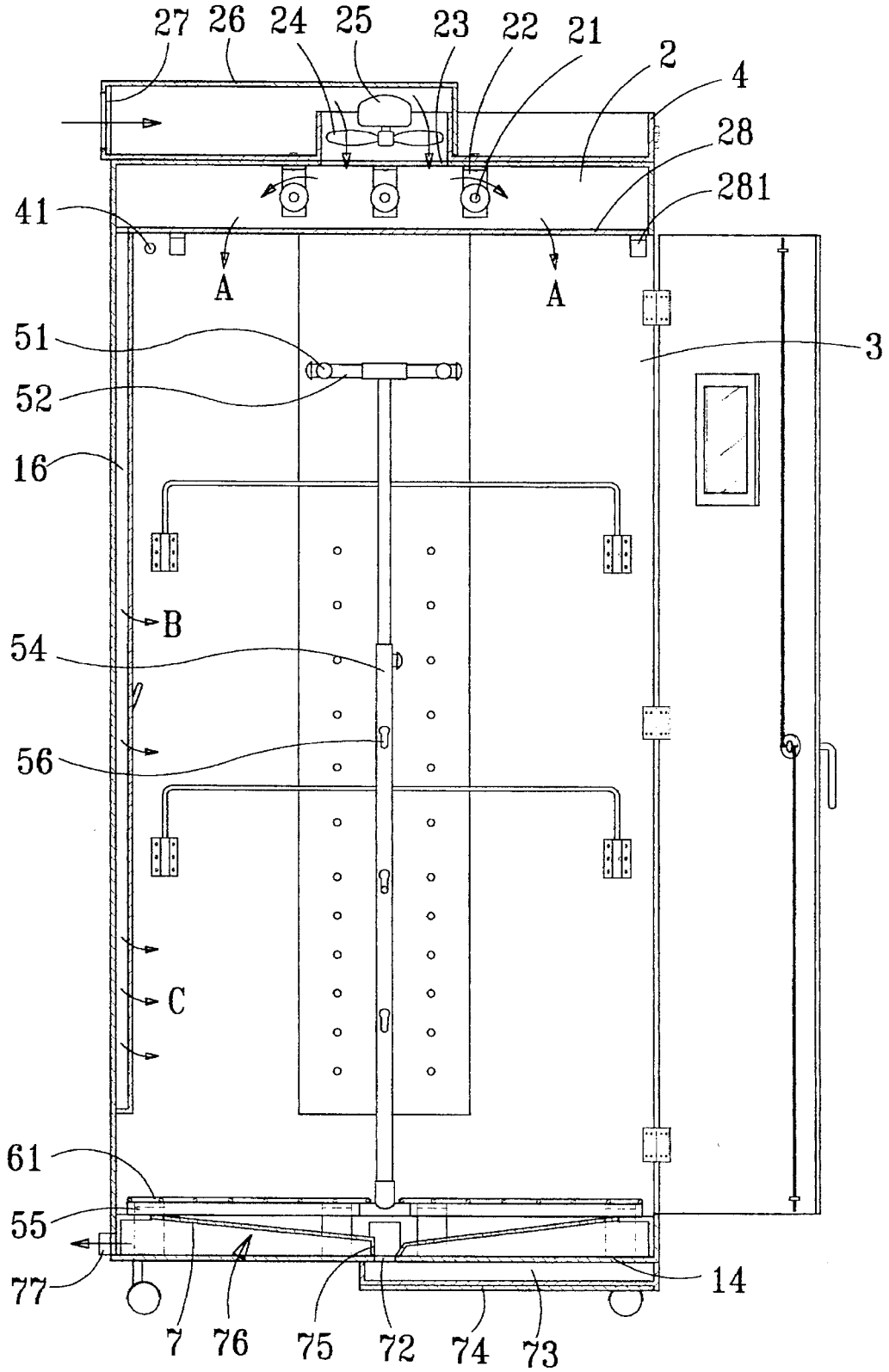
FIG. 3 is a side sectional view of the present invention taken on line 3'—3' of FIG. 2.

FIGS. 1,2 and 3 illustrate a preferred embodiment of the present invention. The drying center according to the present invention includes a cabinet 1 which has a top wall 11, a pair of lateral side walls 12, a rear side wall 13, a bottom wall 14 and a front side wall which has two doors 15 mounted thereon. Each door 15 has a handle 151, and a latch means 152 for opening, closing or locking of the door. A window 153 is provided for viewing of the cabinet interior from outside.

At the upper portion of the cabinet 1 and below the top wall 11 is a heating chamber 2 which has a plurality of heating elements 21, each being preferably a radiative heating tube with a resistance wire embedded inside and heat dissipating fins disposed on the outside surface so that heat can be transferred to the passing air more efficiently. Heating element 21 may be composed of a long resistance wire which has a plural number of connection points at different positions and wires to a temperature setting switch 43 on a control panel 4 located above the top wall 11, thereby different levels of heating power output can be generated when temperature setting switch 43 is turned and connected to different points of contact at the heating element 21. Another alternative is to have a plural number of heating elements 21 as shown in FIG. 1. By wiring the heating elements in parallel or series or a different combination of parallel and series, different levels of heating power output can be achieved. Thus the passing air in the heating chamber will be heated and reach different temperature levels for drying different types of goods. The wiring and electric circuit layout for achieving varying heating power outputs are known in the art and forms no part of the present invention. Heating element 21 is fixed to the under surface of the top wall 11 by bracket 22.

There is an opening 23 formed in the top wall 11 and above the heating element 21. A blower 24 driven by a motor 25 is mounted above the opening 23 for generating forced air passing through the heating element 21. The blower 24 and motor 25 are housed in a casing 26 which has an opening in the rear end upon which a removable air filter 27 is mounted for preventing air borne particles from entering into the heating chamber 2 and drying chamber 3 located in the cabinet 1 below the heating chamber 2 and avoiding contamination of the drying goods held inside of the drying chamber 3. A heat diffusion plate 28, preferably made of metal sheet, is located between the heating chamber 2 and the drying chamber 3 and supported by brackets 281 secured on the side walls. Heat diffusion plate 28 has a plural number of apertures formed therein to allow the heated air entering from the heating chamber 2 into the drying chamber 3. On the inside surface of the side walls 12 and rear wall 13, there is provided a hollow air duct 16 vertically disposed from the heat diffusion plate 28 to the lower portion of the drying chamber 3, near the bottom wall 14. Air duct 12 has an opening at the top end to engage with a cutaway side slot 29 on a lateral side of the heat diffusion plate 28. Thus the heated and forced air in the heating chamber 2 can flow into the air duct 16 through slot 29.The bottom end of the air duct 16 is closed. There is a plural number of apertures formed on the lateral wall of the air duct 16 facing the drying chamber 3. The forced and heated air in the heating chamber 2 can therefore flow into the drying chamber 3 from the heat diffusion plate 28 at the top (arrow A in FIG. 3) and from the air duct 16 on lateral sides (arrows B and C in FIG. 3), thus enabling the heated air to evenly distributed in the entire drying chamber 3 for uniform drying of goods held therein. There is a thermostat 41 disposed in the drying chamber 3 and wired to the control panel 4 for preventing the drying chamber 3 from reaching an high temperature. Control panel 4 is generally a "U" shape frame which has a timer 42, a temperature selection and setting switch 43 and a power on signal light 44 disposed thereon like a conventional dryer.

Inside the drying chamber 3, there is provided a support means which includes a support stand 5 and a base grid 61. In one embodiment according to the present invention, the support stand 5 includes a pair of spaced and transverse bars 51 interconnecting with a pair of spaced and longitudinal bars 52 forming a substantially rectangular and horizontal frame. There is a space distance between the rectangular frame and the side walls of the drying chamber 3. Longitudinal bars 52 are secured on the top ends of a pair of spaced and upright tubes 54.

Upright tubes 54 are preferably telescopically structured. The top ends of the upright tubes 54, consequently the rectangular frame disposed thereon, can be adjusted and moved upward or downward by the control of clamping screw 541. One or both of the transverse bars 51 may also be telescopically structured and may be extended or retracted by the control of a clamping screw 511. The bottom end of the upright tube 54 is secured on a longitudinal base bar 55 which is secured on a pair of brackets 62 attached to the side walls of the cabinet. The interconnection of the bars and tubes set forth above may be done by welding (such as between bars 51 and 52 shown in FIG. 1) or by a coupler (such as 521 between tube 54 and bar 52), or other convenient way known in the art. There is a top grid 512 disposed horizontally in the space of the rectangular frame formed by the bars 51 and 52. On the lateral sides that face each other, the upright tube 54 has a plural number of spaced keyholes 56 formed therein. An inverted "U" shaped center rod 57 is movably and horizontally engaged with a pair of opposite keyholes 56 as shown in FIG. 1. Base grid 61 is supported by pairs of brackets 62' secured on the side walls.

The support stand 5 structured in the way set forth above can provide multiple functions. Transverse bar 51 can be used to support hangers for suspending clothes for drying (refer to FIGS. 4 and 5). Top grid 512 can keep hangers and the clothes hung thereon spaced with each other so that heated air can freely communicate with the surface of the clothes to achieve efficient drying. When telescopic bar 51 is retracted, the horizontal and rectangular frame formed by the bars 51 and 52 has space distance with the side walls, top wall (essentially the heat diffusion plate 28) and bottom wall of the drying chamber 3, and large size or bulky goods can be drapped over the top of the rectangular frame and with the edges of the goods suspended and pendent in the space. Both outside and inside surfaces of the goods can communicate with the heated air for drying. It is particularly useful for drying large size or bulky goods such as bedsheet, blanket, quilt and the like (shown in FIG. 6).

Figure 4:
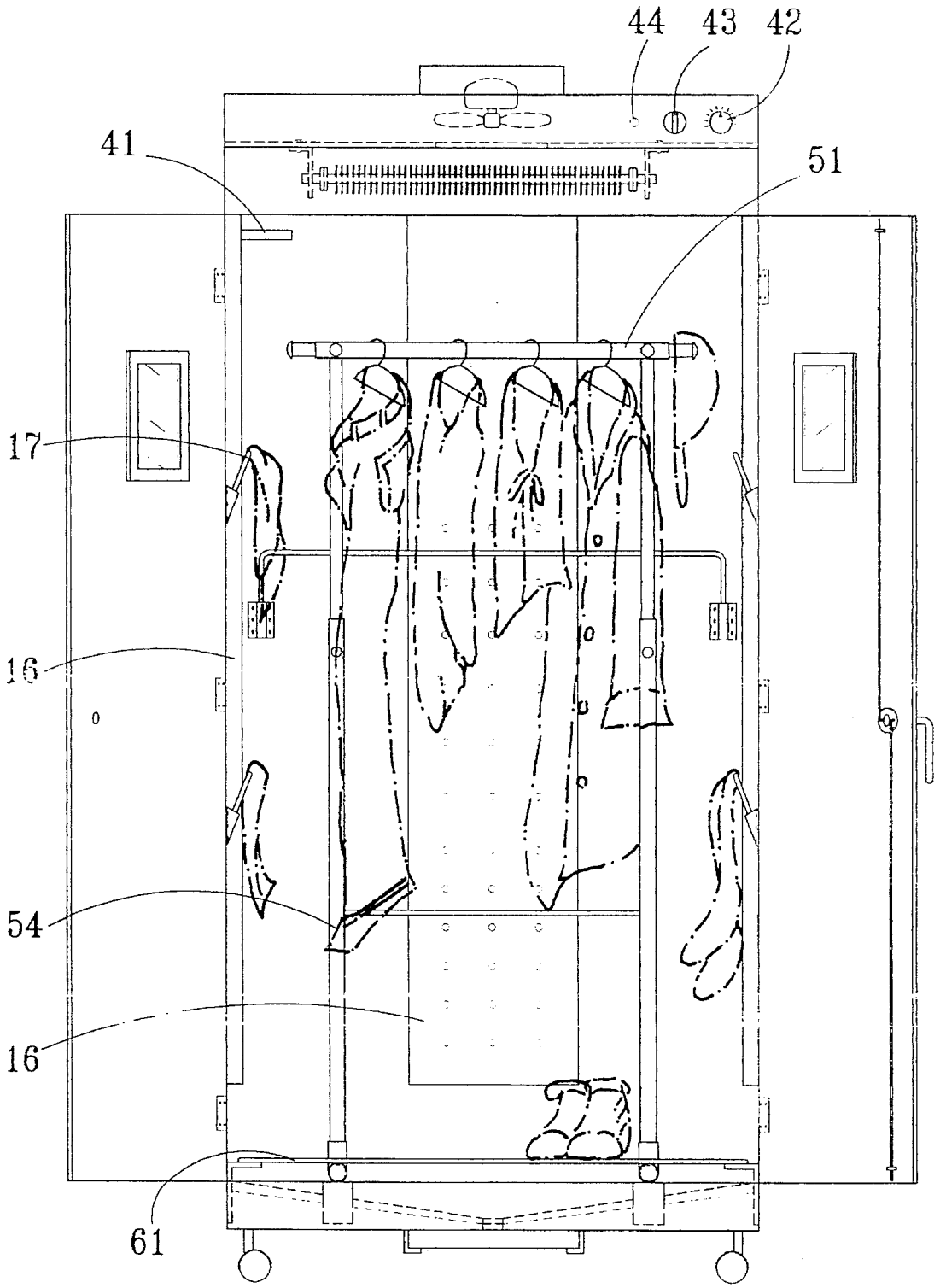
FIG. 4 is a front elevation view of the present invention illustrating for drying ordinary laundry and articles.
Figure 5:
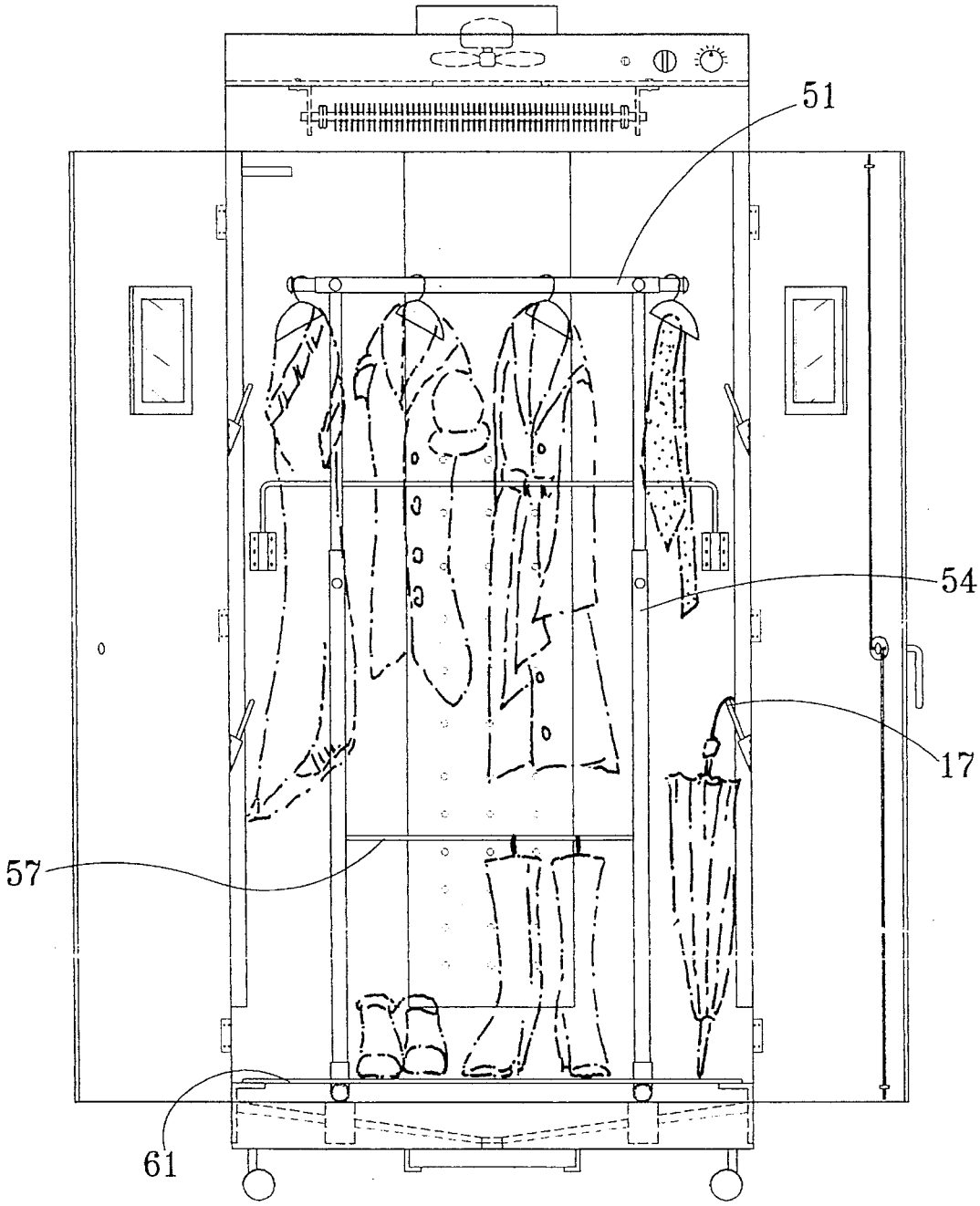
FIG. 5 is a front elevation view of the present invention illustrating for drying rainyday outfits.
Figure 6:
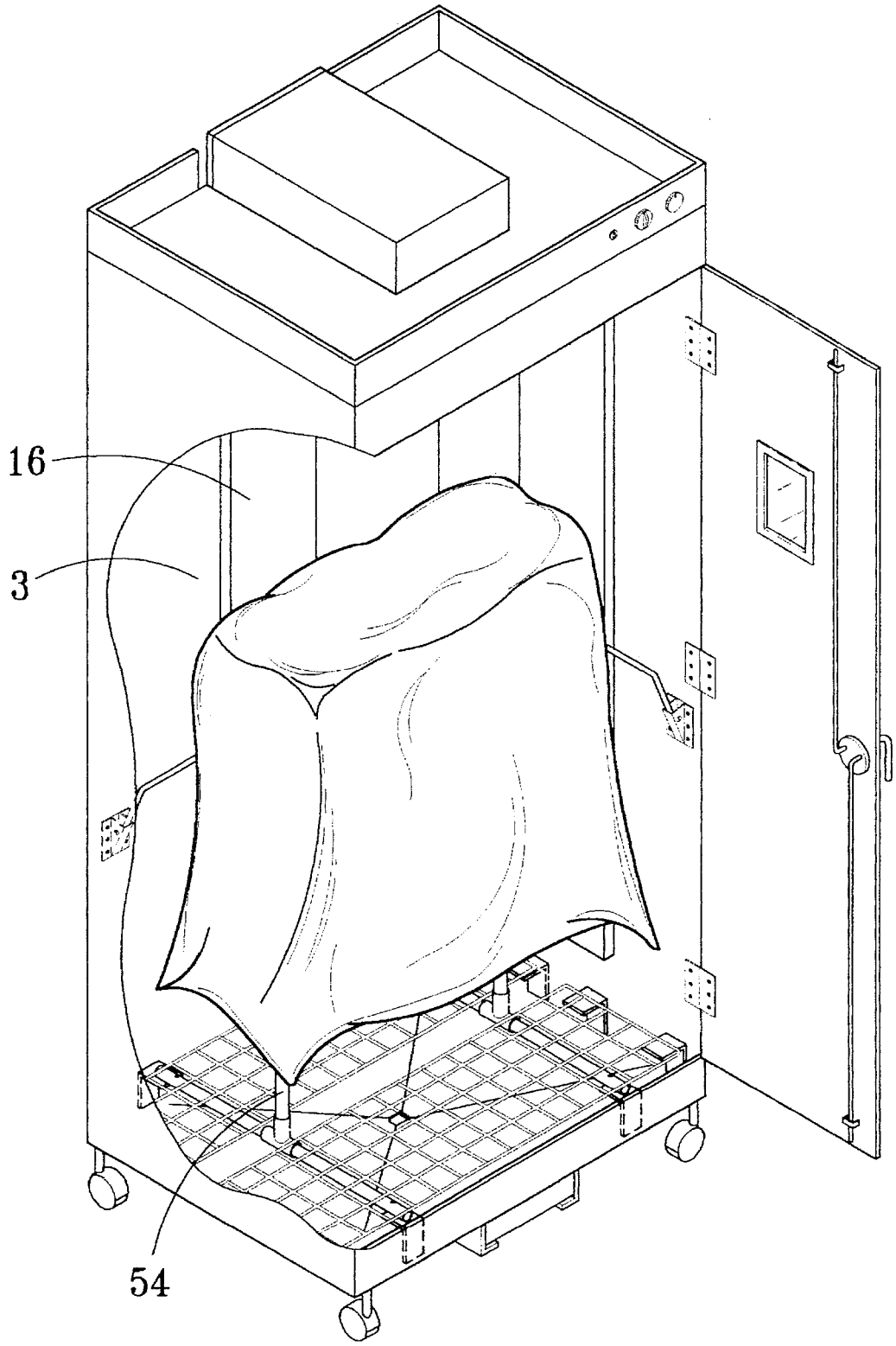
FIG. 6 is a pictorial view, partly cutaway, of the present invention for drying the bulky goods such as a quilt.
Figure 7:
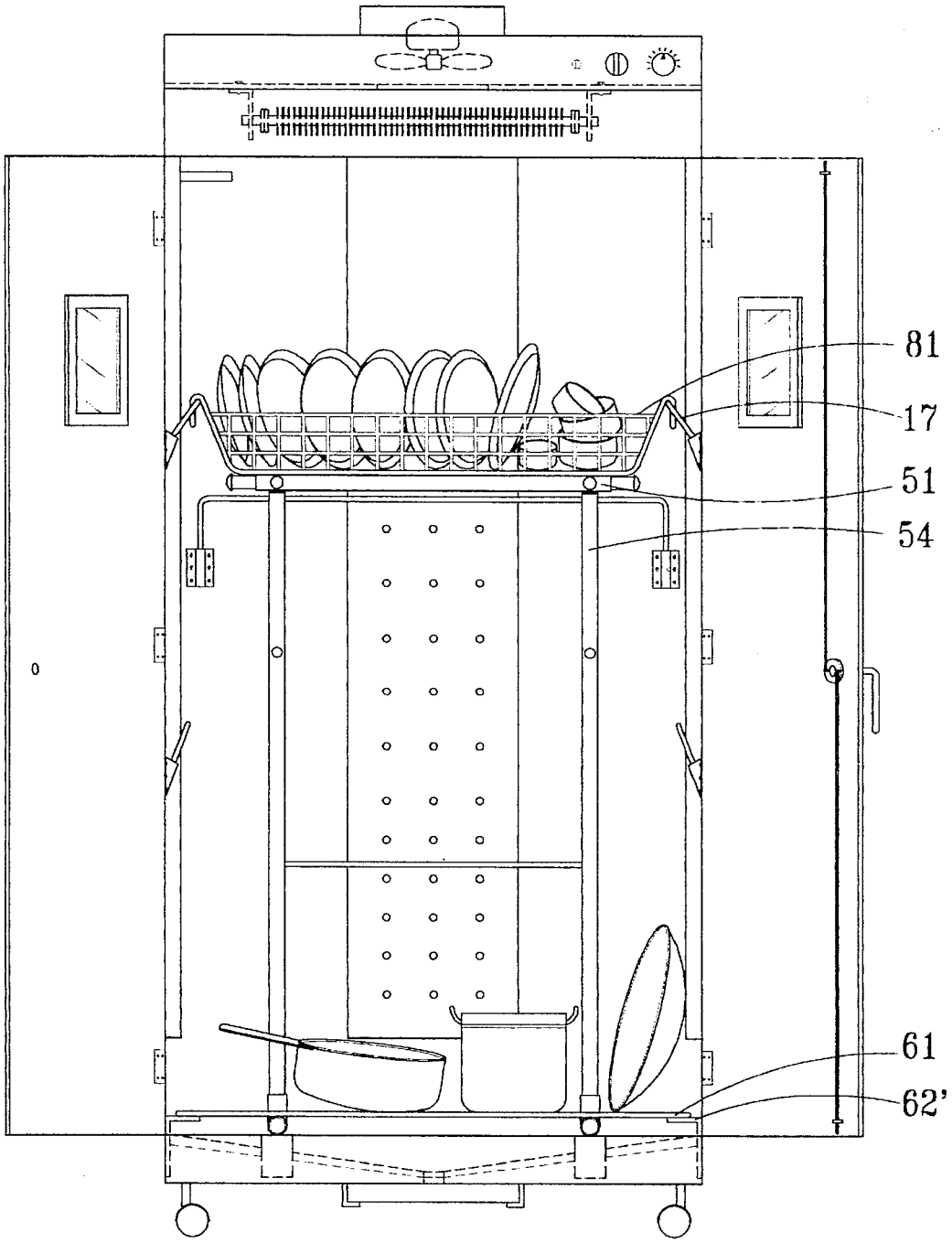
FIG. 7 is a front elevation view of the present invention for drying dishes, tableware and kitchen utensils.

The horizontal and rectangular frame formed by bars 51 and 52 can further support a wire basket which can hold drying goods that are not suitable for hanging such as stuffed toys, knitted wear, woolen sweater, cushion, hat, shoes, dish, tableware and the like (shown in FIG. 7). The movable center rod 57 between the spaced tubes 54 can be used to hang or drap small size articles such as sock, glove or underwear for drying. It also can be used for clipping and holding the odd shape goods such as boots for drying (shown in FIG. 5). The base grid 61 can be used for holding heavy or odd shape goods for drying, including sneakers, shoes, boots, cushion, kitchen utensils and the like (as shown in FIG. 4,5 and 7).

Figure 8:
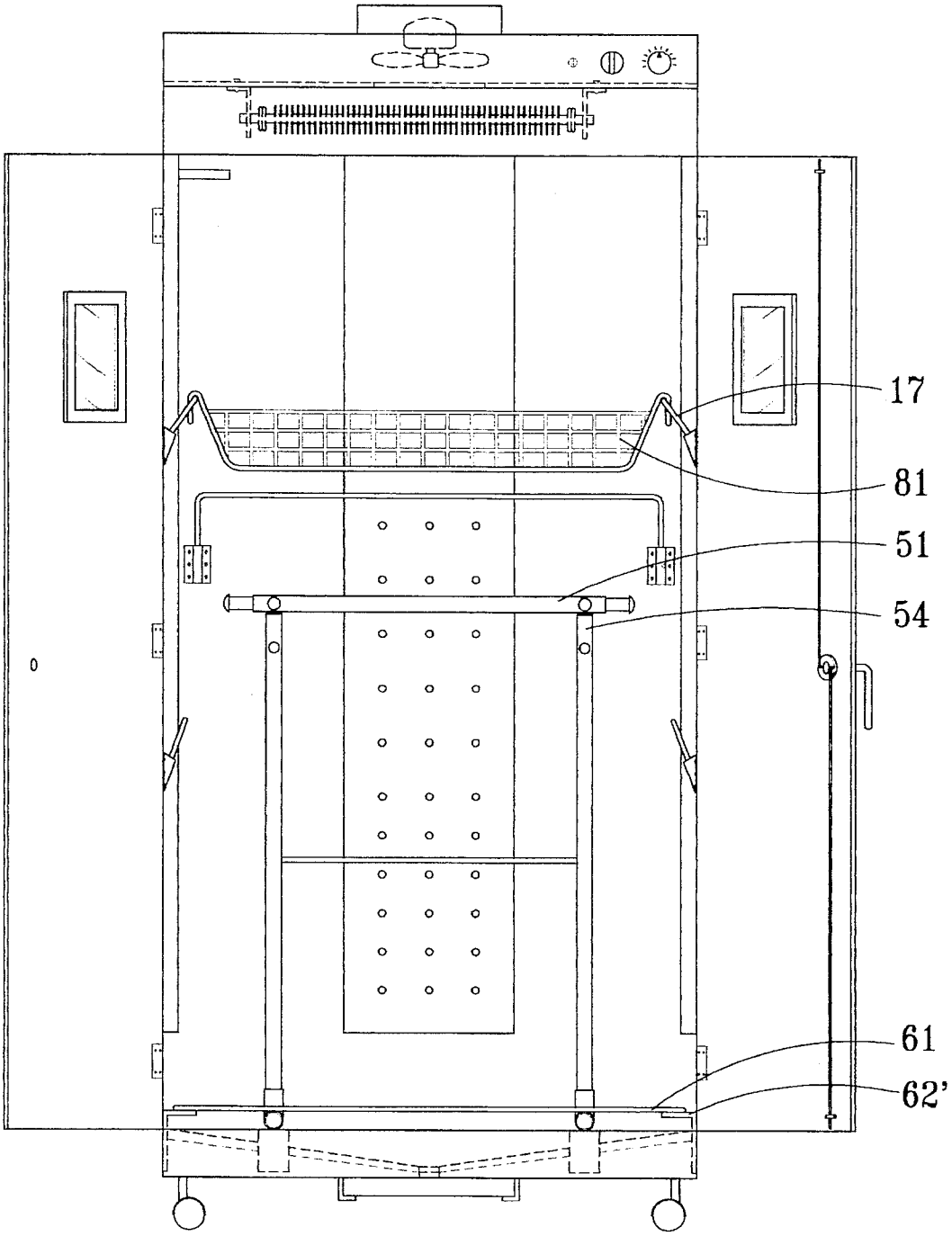
FIG. 8 is a front elevation view of the present invention illustrating a wire basket being held by a pair of opposite side rods.

On the interior surface of the lateral side walls 12 and rear side wall 13, there is provided a substantially horizontal side rod 17, preferably made of high strength metal rod such as stainless steel, which is formed in general an inverted "U" shape and having two pivot arms tiltably engaged with a pair of spaced pivot brackets 171 disposed on the side wall. The side rod 17 can be used to hang or drap small articles for drying, including towel, socks, stockings, pantyhose, handkerchief, towel, underwear and the like. A wet umbrella can also be hung on a side rod for drying (shown in FIGS. 4 and 5). Furthermore, a pair of side rods 17 on the two opposite lateral side walls 12 can also be used to support a wire basket 81 for holding drying goods (refer to FIG. 8). If the wire basket is lightly loaded, the rectangular frame formed by bars 51 and 52 can be freed to hang or drap other goods for drying in the mean time.

When the wire basket is heavily loaded, it is desirable to have the rectangular frame bear the weight and support the wire basket, while the side rods can be used to provide additional and balancing support to keep the wire basket resting on the rectangular frame more securely (refer to FIG. 7). This is particularly true in another embodiment of the present invention which has a simple support stand composed of a single transverse bar rather than a rectangular frame (refer to FIG. 11).

Below the base bars 55 and above the bottom wall 14, there is provided a drain board 7 which substantially covers the entire cross section of the drying chamber 3 and has a sloped surface downwardly directed toward a drip outlet 72 formed about at the center of the drain board 7. A removable drip tray 73 is provided below the drip outlet 72 for collection and disposal of the drip that might result from the wet laundry, sneakers or umbrella. Drip tray 73 is supported by a pair of channels 74 longitudinally disposed under the bottom wall 14.

Adjacent the drip outlet 72, there is provided an air outlet port 75 which engages with an air discharge duct 76 formed between the drain board 7 and bottom wall 14. The other end of the air discharge duct 76 engages with an air discharge port 77 located on the outside surface of the rear side wall 13. The moisture laden air from the drying chamber 3 thus can be discharged out of the cabinet 1 through the air passage formed by air outlet port 75, discharge duct 76 and discharge port 77. The reason for disposing the air outlet port 75 at about the center of the drain board 7 is to enable the heated air to fully communicate with the drying goods held in the interior of the drying chamber 3 before exit, thus further improving the drying efficiency. One or more than one flexible hoses, preferably the one used by conventional washing machine, may be engaged with the discharge port 77 (not shown in the drawings). Thus when the dryer of the present invention is located inside the house, the moisture laden air can be discharged outdoors via the hose.

Under the bottom wall 14, there are provided casters 70 to allow the drying center of the present invention to easily moved to where it is needed.

Figure 9:
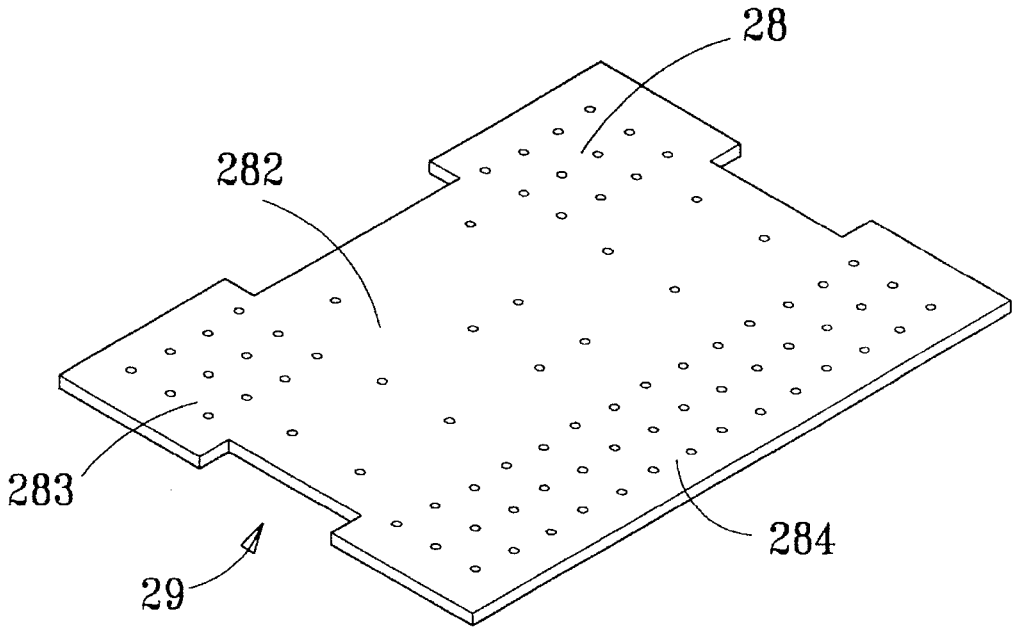
FIG. 9 is a perspective view of an embodiment of the heat diffusion plate of the present invention.

In order to enable the heated air be evenly distributed in the entire drying chamber 3 so that the drying goods held therein can be dried uniformly, besides the air duct 16 which can channel heated air directly into middle and lower portion of the drying chamber 3 along the side wall, the heat diffusion plate 28 should also be properly designed to allow an amount of heated air flowing into the air duct 16. FIG. 9 illustrates one embodiment of a heat diffusion plate 28. It is preferably made of perforated metal sheet so that heat transferred from the heating elements and heated air can be evenly diffused across the entire plate, thus reducing the risk of heat concentration in certain areas and prevent possible burning. Heat diffusion plate 28 can also prevent the clothes or goods held in the drying chamber from direct contact with the heating element, thus also preventing possible burning. Heat diffusion plate 28 has side slots 29 formed on the edges adjacent the lateral and rear side walls for engaging with the top opening end of the air duct 16. The blower 24 (refer to FIGS. 1 and 3)is disposed substantially above the center portion of the heat diffusion plate 28. The center portion has the shortest distance of forced air path to normally allow the greatest amount of air to pass through. There could be a possibility that the side slots 29 and air duct 16 do not receive a sufficient amount of heated air. It is therefore desirable that the apertures on the heat diffusion plate 28 be specially arranged and patterned. FIG. 9 illustrates one such arrangement which has a number of apertures widely spaced along the path 281 from the center portion to the side slots 29, while the other portions such as 282 and 283 in the front where no side slot for air duct being formed due to door installation, the apertures are more closely spaced. Thus less amount of heated and forced air will escape from the heating chamber 2 in the center portion and enable air duct 16 to receive a sufficient amount of heated air.

Another alternative aperture arrangement on heat diffusion plate 28 is to have smaller apertures or no apertures at all at the center portion or on the path 281 which leads to the side slot 29.

The proper design of the air duct can also improve the uniform distribution of heated air in the drying chamber. One embodiment is to have the apertures in the air duct be spaced differently as shown in FIGS. 1 and 2. The upper portion 161 of the air duct 16 has no apertures formed therein, as it closes the heat diffusion plate 28 which allows enough heated air to flow downward in the upper portion of the drying chamber (arrow A in FIG. 3). In the middle portion 162 of the air duct 16, there is a plural number of spaced apertures formed therein to allow some of the heated air coming from the heating chamber to vent out into the middle portion of the drying chamber (arrow B in FIG. 3). The lower portion 163 of the air duct 16 is remote from the heating chamber, and the apertures formed therein are more closely spaced than that in the middle portion 162, so that an amount of heated air can be allocated and flow into the lower portion of the drying chamber (arrow C in FIG. 3).

The arrangement set forth above has eventually the same effect of extending the heating chamber around the drying chamber so that the goods held inside can be more uniformly dried. There are other alternatives to meet this purpose, such as to have smaller apertures in the middle portion 162 and to have larger apertures at the lower portion 163.

In order to reduce heat loss when heated air flows in the air duct 16, the adjacent outside wall of the drying chamber may be padded with suitable heat insulating material or laminate (no shown).

Figure 10:
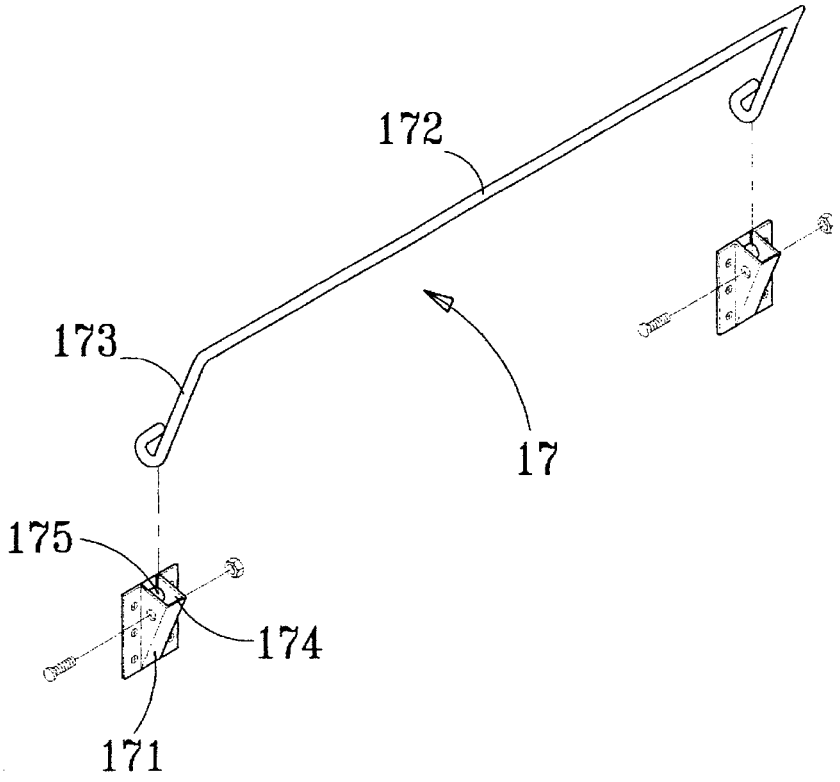
FIG. 10 is a perspective view of an embodiment of the side rod of the present invention.

In order to efficiently use the drying chamber and to provide additional support means for hanging or holding the drying goods, the present invention contemplates disposing side rod 17 on the side walls of the interior surface of drying chamber. FIGS. 1 and 10 illustrate such an embodiment. Side rod 17, preferably made of high strength metal rod such as stainless steel, is generally formed in an inverted "U" shape. The middle portion 172 is substantially horizontally disposed while each of two pivot arms 173 is engaged respectively with a pivot bracket 171 which has a center slot 174 to receive a pivot arm 173. There is a lug 175 projected sideward in the slot 174. Once the pivot arm 173 is inserted into the center slot 174 and fastened, horizontal rod 172 may be tilted upward to keep close contact with the lateral side wall of the air duct 16. Lug 175 will keep the pivot arm 173 from falling downward. By moving the pivot arm 173 outward and passing the lug 175, horizontal rod 172 can be moved away from the air duct 16 and side wall 12 or 13, and keep a space distance with the air duct and side wall, and can be used for hanging or draping small articles for drying. Although FIG. 1 shows side rods only on the lateral and rear side walls, and a side rod can be disposed on the rear surface of the door 15 equally well if desired.

Figure 11:
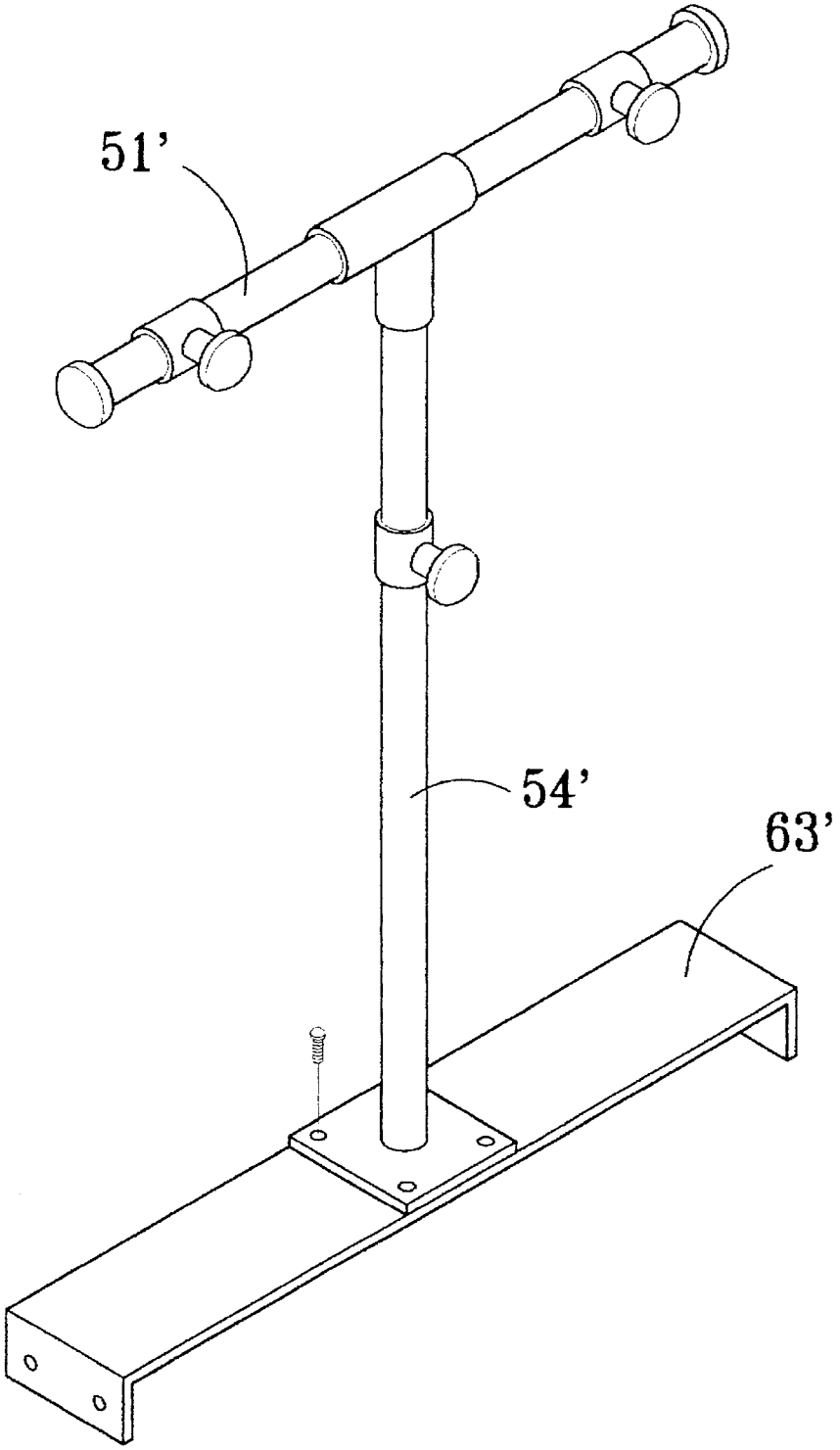
FIG. 11 is a perspective view of another embodiment of the support stand of the present invention.
Figure 12:
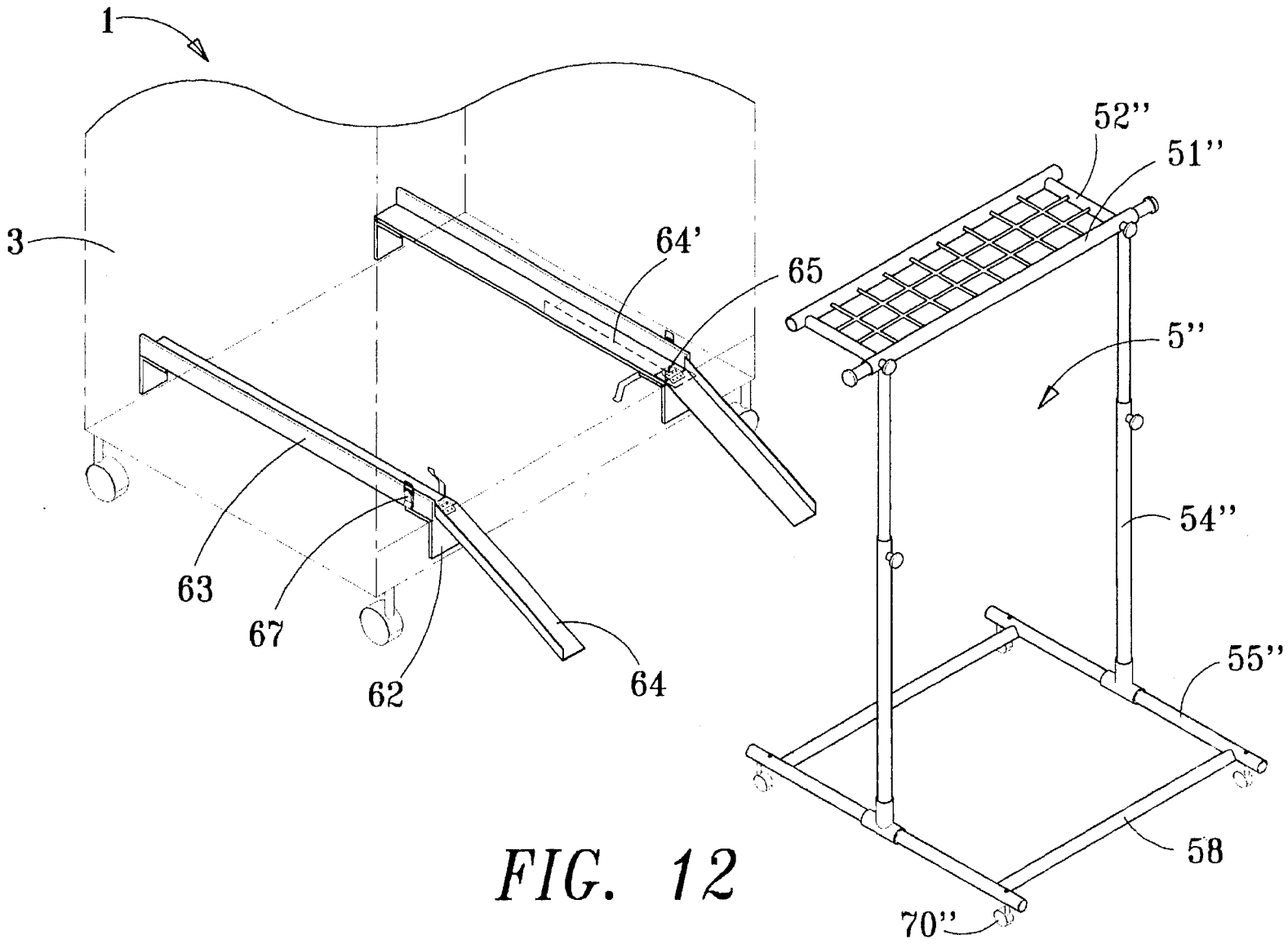
FIG. 12 is a perspecctive view of yet another embodiment of the support stand and the base frame of the present invention.

Support stand 5 shown in FIG. 1 has a substantially rectangular frame composed of two pairs of interconnecting bars 51 and 52 which are supported by a pair of spaced upright tubes 54 disposed on a pair of base bars 55 which are secured on a pair of brackets 62 attached on the side walls. Eventually many other forms of modification may be made for a support stand. FIG. 11 illustrates another embodiment of a support stand in a simple and low cost structure. It composed of a single transverse and horizontal bar 51' secured on the top end of an upright telescopic tube 54' which is disposed on a base frame 63'. Bar 51' may also be telescopically structured. When extended, bar 51' can support hangers for suspending clothes for drying. When extracted, it can also allow large or bulky goods to drape over for drying. Although it's drying efficiency might be less than the one shown in FIG. 1, it is still better than a cloth line due to bar 51' usually having a greater diameter than the cloth line, thus allowing more inside surface of the drying goods communicating with the heated air. It cannot directly support a wire basket on its top, but can do that indirectly. For a lightly loaded wire basket, such as one holding hat, knitted wear, woolen sweater, the two side rods 16 in the opposite side walls 16 can be used to support a wire basket without the stand (shown in FIG. 8). For a heavily loaded wire basket, such as one holding shoes, sneakers or dishes, it is preferably rested on a pair of opposite side rods first, then move and adjust the vertical tube 54' until bar 51' reaches the bottom of the wire basket. Then bar 51' will bear most of the weight of the loaded basket while the side rods are mainly to secure and keep the wire basket balanced, lest it tilts sidewardly (refer to FIG. 7). FIG. 12 illustrates yet another embodiment according to the present invention. The support stand 5" is similarly structured like the one shown in FIG. 1 except that the top rectangular frame is formed by a pair of spaced bars 51" and a pair of spaced bars 52" which are secured on the top ends of a pair of spaced and vertical tubes 54" in cantilever fashion. The two spaced base bars 55" are connected by a pair of spaced rods 58 and have casters 70" disposed thereunder. Support stand 5" thus is portable and movable. It can be moved out of the drying chamber 3 (shown in FIG. 12) and be easily moved to another place in a house. There are a number of occasions when it might be desirable to do so. One such an occasion is to move out the support stand 5" for draping large size and bulky goods such as very thick and heavy quilt or comforter. It would be more convenient to do so when the support stand 5" is at a roomy space outside the confined drying chamber 3. The other occasion is when sun shine is available and accessible outdoor or indoor. Instead of using a dryer and consuming electricity, it is more commendable to dry goods under sun shine. Support stand 5" is very handy and convenient for hanging, drapping or holding a wide variety of goods for this purpose.

In order to facilitate the moving of the support stand 5" into or out of the drying chamber 3, there is provided a pair of spaced and longitudinal base frame 63 each resting on a pair of brackets 62. A bridge plank 64 is hinged at one end and secured on the base frame 63 so that another end thereof can be rested on the floor to form a slope allowing the support stand 5" be easily moved up or down on the base frame 63. Another side of the hinge is centered on a screw bolt 65 which enable the bridge plank 64 be swung and rested on the base frame 63 (shown in dotted line 64' in FIG. 12) once the support stand 5" is moved in or moved out. When the support stand 5" is moved in the cabinet and rested on the base frame 63, a buckle 67 affixed on the base frame 63 can be used to fasten the base tube 55" firmly in place. During the moving of the support stand 5", it is preferable to remove the base grid 61 to free it the interference with the buckle 67.

It may thus be seen that the objects of the present invention set forth herein, as well as those made apparent from the foregoing description, are efficiently attained. While the preferred embodiments of the invention have been set forth for purpose of disclosure, modifications of the disclosed embodiments of the invention as well as other embodiments thereof may occur to those skilled in the art. Accordingly, the appended claims are intended to cover all embodiments which do not depart from the spirit and scope of the present invention.

What is claimed is:

1. A household drying center for drying laundry, fabric articles and household goods, comprising:

a cabinet defined by a top wall, a bottom wall and a plurality of side walls, the top wall having an opening formed therein, the bottom wall having a plurality of casters disposed thereunder;

a heating chamber located at an upper portion of the cabinet and below the top wall, the heating chamber including heating means and a substantially horizontal heat diffusion plate located below the heating means; the heat diffusion plate including a plurality of lateral edges in contact with the side walls of the cabinet, a plural number of apertures formed therein and a substantially rectangular side slot formed in each of a rear and lateral side edge;

a blower disposed above the opening of the top wall for generating forced air into the heating chamber, the blower being housed in a case which has a rear opening upon which an air filter means is mounted;

a control panel located above a front side wall of the cabinet and including a timer for setting the operation duration of the heating means and the blower, a temperature selection switch for setting the heating means to generate one of various predetermined heating power outputs and a signal light for indicating the operative state of the heating means and the blower;

a drying chamber located in the middle and lower portions of the cabinet below the heat diffusion plate, the drying chamber including a door mounted on the front side wall for accessing the interior of the drying chamber, a thermostat for setting the heating means to an inoperative state when the temperature of the interior of the drying chamber reaches a predetermined level, a plurality of hollow air ducts, and a side rod means;

each air duct being substantially rectangular in cross section and vertically disposed on each of a rear and lateral side wall and having an open top end engaged with the side slot of the heat diffusion plate for forming an air passage to the heating chamber, a closed bottom end and a plural number of apertures facing the interior of the drying chamber;

the side rod means including at least one substantially inverted 'U' shape rod having two ends, a substantially horizontal middle portion and two pivot arms at the ends, each pivot arm being tiltably engaged with a pivot bracket disposed on an interior surface of a side wall of the drying chamber;

a support means including a support stand and a base grid disposed in the drying chamber, the support stand including a substantially rectangular frame formed by a pair of transverse bars and a pair of longitudinal bars, and a pair of transversely spaced uprights with the top ends thereof engaging with the rectangular frame and with the bottom ends thereof secured on a pair of spaced and longitudinal base bars which are secured on two opposite side walls of the cabinet;

the rectangular frame being spaced from the heat diffusion plate, the side walls and the bottom wall of the cabinet; and the base grid resting on plural pairs of brackets located on two opposite side walls of the cabinet and disposed horizontally above the base bars;

a draining means located below the base bars and above the bottom wall, the draining means including a drain board which has a surface inclined downwardly from lateral sides thereof to a drain outlet formed in a center thereof, and a drip tray movably disposed below the drain outlet and under the bottom wall of the cabinet; and an air discharge means including an air outlet formed adjacent the drain outlet, and a hollow air discharge duct located below the drain board, the discharge duct having a front end in fluid communication with the air outlet and a rear end in fluid communication with an air discharge port disposed on an outside surface of the rear side wall of the cabinet.

2. A household drying center for drying laundry, fabric articles and household goods, comprising:

a cabinet defined by a top wall, a bottom wall and a plurality of side walls, the top wall having an opening formed therein, the bottom wall having a plurality of casters disposed thereunder;

a heating chamber located at an upper portion of the cabinet and below the top wall, the heating chamber including heating means and a substantially horizontal heat diffusion plate located below the heating means; the heat diffusion plate including a plurality of lateral edges in contact with the side walls of the cabinet, a plural number of apertures formed therein and a substantially rectangular side slot formed in each of a rear and lateral side edge;

a blower disposed above the opening of the top wall for generating forced air into the heating chamber, the blower being housed in a case which has a rear opening upon which an air filter means is mounted;

a control panel located above a front side wall of the cabinet and including a timer for setting the operation duration of the heating means and the blower, a temperature selection switch for setting the heating means to generate one of various predetermined heating power outputs and a signal light for indicating the operative state of the heating means and the blower;

a drying chamber located in the middle and lower portions of the cabinet below the heat diffusion plate, the drying chamber including a door mounted on the front side wall for accessing the interior of the drying chamber, a thermostat for setting the heating means to an inoperative state when the temperature of the interior of the drying chamber reaches a predetermined level, a plurality of hollow air ducts, and a side rod means; each air duct being substantially rectangular in cross section and vertically disposed on each of a rear and lateral side wall and having an open top end engaged with the side slot of the heat diffusion plate for forming an air passage to the heating chamber, a closed bottom end and a plural number of apertures facing the interior of the drying chamber; the side rod means including at least one substantially inverted 'U' shape rod having two ends, a substantially horizontal middle portion and two pivot arms at the ends, each pivot arm being tiltably engaged with a pivot bracket disposed on an interior surface of a side wall of the drying chamber;

a support means including a support stand and a base grid disposed in the drying chamber, the support stand including a substantially horizontal and rectangular frame formed by a pair of transverse bars and a pair of longitudinal bars, a pair of transversely spaced uprights with the top ends thereof engaging with the rectangular frame and a base means, wherein the base means includes a pair of spaced longitudinal base bars which have the bottom end of the spaced uprights secured thereupon and the casters disposed thereunder, a pair of spaced and longitudinal base frames upon which the base bars are removably secured by a pair of buckle fasteners disposed thereon, the base frames being secured on the two opposite side walls of the cabinet, and a pair of spaced bridge planks, each bridge plank having one end hinged and swivelbly centered on a front end of the base frame and another end for resting on the ground to form a slope and capable of swiveling to rest on the base frame; the rectangular frame being spaced from the heat diffusion plate, the side walls and the bottom wall of the cabinet; and the base grid resting on plural pairs of brackets located on two opposite side walls of the cabinet and disposed horizontally above the base bars;

a draining means located below the base bars and above the bottom wall, the draining means including a drain board which has a surface inclined downwardly from lateral sides thereof to a drain outlet formed in the center thereof, and a drip tray movably disposed below the drain outlet and under the bottom wall of the cabinet; and an air discharge means including an air outlet formed adjacent the drain outlet and a hollow air discharge duct located below the drain board, the discharge duct having a front end in fluid communication with the air outlet and a rear end in fluid communication with an air discharge port disposed on an outside surface of the rear side wall of the cabinet.

3. A household drying center according to claim 1 or 2, wherein at least one of the transverse bars of the rectangular frame is telescopically structured.

4. A household drying center according to claim 1 or 2, wherein the rectangular frame has a grid disposed therein between the transverse and longitudinal bars.

5. A household drying center according to claim 1 or 2, wherein the spaced upright has a plural number of spaced keyholes formed vertically in the lateral wall facing each other and allows a substantially inverted "U" shape rod be engaged at two ends thereof with a pair of opposite keyholes.

6. A household drying center according to claim 1 or 2, wherein the spaced uprights are telescopically structured.

7. A household drying center for drying laundry, fabric articles and like household goods, comprising:

a cabinet defined by a top wall, a bottom wall and a plurality of side walls, the top wall having an opening formed therein, the bottom wall having a plurality of casters disposed thereunder;

a heating chamber located at an upper portion of the cabinet and below the top wall, the heating chamber including heating means and a substantially horizontal heat diffusion plate located below the heating means; the heat diffusion plate including a plurality of lateral edges in contact with the side walls of the cabinet, a plural number of apertures formed therein and a substantially rectangular side slot formed in each of a rear and lateral side edge;

a blower disposed above the opening of the top wall for generating forced air into the heating chamber, the blower being housed in a case which has a rear opening upon which an air filter means is mounted;

a control panel located above a front side wall of the cabinet and including a timer for setting the operation duration of the heating means and the blower, a temperature selection switch for setting the heating means to generate one of various predetermined heating power outputs and a signal light for indicating the operative state of the heating means and the blower;

a drying chamber located in the middle and lower portions of the cabinet below the heat diffusion plate, the drying chamber including a door mounted on the front side wall for accessing the interior of the drying chamber, a thermostat for setting the heating means to an inoperative state when the temperature of the interior of the drying chamber reaches a predetermined level, a plurality of hollow air ducts, and a side rod means;

each air duct being substantially rectangular in cross section and vertically disposed on each of a rear and lateral side wall and having an open top end engaged with the side slot of the heat diffusion plate for forming an air passage to the heating chamber, a closed bottom end and a plural number of apertures facing the interior of the drying chamber; the side rod means including at least one substantially inverted 'U' shape rod having two ends, a substantially horizontal middle portion and two pivot arms at the ends, each pivot arm being tiltably engaged with a pivot bracket disposed on an interior surface of a side wall of the drying chamber;

a support means including a support stand and a base grid disposed in the drying chamber, the support stand including a substantially horizontal and transverse bar secured on the top end of a telescopic upright, the upright having a bottom end secured on a base frame which is secured on two opposite walls of the cabinet; wherein the transverse bar is telescopic and spaced from the heat diffusion plate, the side walls and the bottom wall of the cabinet; and the base grid resting on plural pairs of brackets located on two opposite side walls of the drying chamber and disposed horizontally above the base frame;

a draining means located below the base bars and above the bottom wall, the draining means including a drain board which has a surface inclined downwardly from lateral sides thereof to a drain outlet formed in a center thereof, and a drip tray movably disposed below the drain outlet and under the bottom wall of the cabinet; and an air discharge means including an air outlet formed adjacent the drain outlet, and a hollow air discharge duct located below the drain board, the discharge duct having a front end in fluid communication with the air outlet and a rear end in fluid communication with an air discharge port disposed on an outside surface of the rear side wall of the cabinet.

8. A household drying center according to claim 1,2 or 7, wherein the heating means including radiative heating element which has resistance core embedded therein and has heat dissipating fins disposed on the outside surface thereof.

9. A household drying center according to claim 1, 2 or 7, wherein the apertures in the heat diffusion plate are formed in such way that the apertures located between the center portion and the side slot thereof have greater space distance than the apertures located elsewhere thereof.

10. A household drying center according to claim 1,2or 7, wherein the apertures in the air duct are formed in such way that no aperture is formed in the upper portion thereof near the heat diffusion plate, the apertures located in the middle portion thereof have greater space distance than the apertures located in the lower portion thereof near the bottom wall of the cabinet.

* * * * *